US008545262B2

(12) United States Patent
Schmidt

(10) Patent No.: US 8,545,262 B2
(45) Date of Patent: Oct. 1, 2013

(54) SHORTING CLIP FOR AN AIRBAG IGNITION SYSTEM

(75) Inventor: Thomas Schmidt, Nuremberg (DE)

(73) Assignee: Delphi International Operations Luxembourg, S.A.R.L., Luxembourg (LU)

( * ) Notice: Subject to any disclaimer, the term of this patent is extended or adjusted under 35 U.S.C. 154(b) by 179 days.

(21) Appl. No.: 12/998,907

(22) PCT Filed: Dec. 16, 2008

(86) PCT No.: PCT/IB2008/055677

§ 371 (c)(1), (2), (4) Date: Jun. 15, 2011

(87) PCT Pub. No.: WO2010/070391

PCT Pub. Date: Jun. 24, 2010

(65) Prior Publication Data

US 2012/0052751 A1 Mar. 1, 2012

(51) Int. Cl.
*H01R 31/08* (2006.01)

(52) U.S. Cl.
USPC ..... 439/507; 439/188

(58) Field of Classification Search
USPC ..... 439/507–513, 125, 188
See application file for complete search history.

(56) References Cited

U.S. PATENT DOCUMENTS

| | | | | |
|---|---|---|---|---|
| 5,275,575 | A * | 1/1994 | Cahaly et al. | 439/188 |
| 5,577,921 | A * | 11/1996 | Philyaw et al. | 439/125 |
| 6,358,084 | B1 * | 3/2002 | Rieger et al. | 439/507 |
| 6,663,421 | B1 * | 12/2003 | Glick et al. | 439/507 |

FOREIGN PATENT DOCUMENTS

| | | | |
|---|---|---|---|
| EP | 0 740 369 | A2 | 10/1996 |
| EP | 1 073 160 | A1 | 9/2001 |
| EP | 1 130 692 | A2 | 9/2001 |
| EP | 401 063 | A1 | 3/2004 |

* cited by examiner

*Primary Examiner* — Truc Nguyen
(74) *Attorney, Agent, or Firm* — Robert J. Myers

(57) ABSTRACT

Shorting clip for an ignition system adapted to be mounted in a retainer insert, including two contact members adapted to each contact a pin of a squib to short-circuit the pins and a first grounding contact adapted to contact a ground contact of a squib connector and at least one second grounding contact adapted to contact an electroconductive part of a squib. The clip further includes a support structure connecting the contact members and the first and second grounding contact with each other, which support structure is adapted to be arranged essentially parallel to the plug-in direction of the retainer insert.

15 Claims, 4 Drawing Sheets

SHORTING CLIP FOR AN AIRBAG IGNITION SYSTEM

1. FIELD OF THE INVENTION

The invention relates to shorting clips for connector assembly used in Safety (or Supplemental) Restraint Systems. Such connector assembly are for instance, mounted on ignition systems of seat-belt pretensioners or airbags. More particularly, shorting clips are mounted on retainer inserts of these ignition systems.

2. TECHNICAL BACKGROUND

Modern passenger cars have a number of SRS devices (Safety Restraint Systems) such as airbags and seat belt pretensioner. Deceleration sensors in the passenger vehicle detect high deceleration values as they occur in case of an accident and send a trigger signal via a wire or cable to the SRS devices. Then, for instance, airbags are inflated by means of an explosive device known as a squib. The wires or cables from the deceleration sensor are connected to the squib by means of a so-called squib connector. To this aim the squib is usually provided with a socket which contains two contact pins. The squib connector comprises a plug part corresponding to the socket, which plug part has two terminal cavities for the insertion of the contact pins of the squib socket. To improve the connection between squib and squib connector airbag retainer inserts were developed, which are adapted to fit into the receptacle of standardized airbag squibs and which facilitate and secure the connection between squib and squib connector. These retainer inserts are commonly provided with some kind of shorting clip, which short-circuits the contact pins of the airbag squib before a squib connector is connected to the squib and which retainer insert further provides mechanical fastening means for a secure mechanical connection of squib connector and squib receptacle. The retainer inserts are sometimes also referred to as shorting inserts.

The EP 1 401 063A1 describes a construction comprising a retainer insert having a shorting clip mounted thereto. The shorting clip is provided with two contact tongues to short-circuit the contact pins of an airbag squib, which contact tongues are connected by means of a common portion, which is provided with two apertures for the reception of the contact pins. The portion of the clip connecting the functional elements of the clip is arranged between the base of the retainer insert and the bottom of the squib receptacle. The base of the retainer insert is provided with corresponding cut outs such that the common portion of the shorting clip is essentially flush with the base of the retainer insert. However, this construction necessitates that the retainer has to be specifically shaped to accommodate the shorting clip and that therefore the shorting clip cannot be used with standardized retainer inserts.

It is therefore an object of the present invention to provide a shorting clip for an airbag ignition system as well as a shorting system comprising a retainer insert and a shorting clip, which reduces or minimizes problems and disadvantages of the above prior art. It is in particular an object of the present invention to provide a shorting clip, which can be used with standardized airbag retainer inserts, without the necessity to change the design of the standardized retainer insert. It is a further object of the invention to provide a shorting clip adapted to be mounted to an airbag retainer insert, which reduces the installation height of an airbag retainer insert provided with the clip and which is of a more flexible construction to reduce the necessity for tight production tolerances. It is a further object of the invention to provide a shorting clip, which provides a shorting function for the pins of an airbag squib and which is adapted to provide at the same time a full grounding contact between the squib connector and the housing of the airbag squib, e.g. the receptacle of an airbag squib.

These and other objects, which become apparent upon reading the following description, are at least partly solved by a shorting clip according to claim 1 and a shorting system according to claim 9.

3. SUMMARY OF THE INVENTION

According to the invention a shorting clip for an ignition system is provided, which is adapted to be mounted in a retainer insert, in particular to a standardized retainer insert. The clip comprises two contact members adapted to each contact a pin of a squib to short-circuit the pins. This function is per se known and described in for example the document mentioned above. The clip further comprises a first grounding contact, which is adapted to contact a ground contact of a squib connector. In this way the shorting clip can be grounded via the ground contact of the squib connector with the mass of the vehicle. Further, the shorting clip is provided with at least one second grounding contact, which is adapted to contact an electroconductive part of an the squib, as for example the metallic housing of the squib receptacle, into which the retainer insert can be mounted. By means of the second grounding contact it is possible to establish a ground continuity between the mass of the vehicle (via the ground contact of the squib connector) and the squib, before a contact is established between the pins of the squib and the corresponding counter contacts provided in the squib connector. The shorting clip further comprises a support structure connecting the contact members and the grounding contacts with each other, which support structure is adapted to be arranged essentially parallel to the plug in direction of the retainer insert. In other words, the support structure connecting the mentioned functional elements is not provided in form of a base, arranged under the base of the retainer insert but in contrast only consists of a structure, which runs essentially parallel to the longitudinal direction of the retainer insert and which therefore has no influence to the installation height of the retainer insert inside of the squib receptacle.

Thus, all these members of the shorting clip are supported by a structure, which is arranged essentially parallel to the plug in direction of the retainer insert and which is most preferably arranged completely inside of the retainer insert. Since all members are connected by the same structure no differences in the electrical potential occurs. Obviously, at least the functional parts of the shorting clip have to be electrically connected with each other.

The shorting clip of the invention, in all the embodiments described herein, is preferably made from one integral piece of metal sheet. In this way all elements of the clip are electrically connected with each other. To achieve the desired shape, the metal sheet is for example stamped and bent as desired. In this way it is possible to achieve thin support structures which are arranged parallel to the plug-in direction (instead of perpendicular as in the prior art) and which are therefore suitable to be mounted to e.g. standardized retainer inserts without increasing the necessary installation height.

The present invention also relates to a shorting system for an ignition system, comprising a retainer insert and a shorting clip, which is adapted to be mounted in the retainer insert. The retainer insert has for example a substantially cylindrical shape with a base provided with at least one opening adapted to receive the pins of a squib, and a front face adapted to receive a plug part of a squib connector. Between base and front face preferably cylindrical walls or wall sections are arranged. The retainer insert is adapted to be inserted into a squib receptacle whereby the front face is facing outwardly and the base faces to the bottom of the receptacle. The shorting system addressed by the present invention can be used with any of the shorting clips described herein. Therefore, the shorting system also comprises for example a shorting clip adapted to be mounted in the retainer insert, which comprises two contact members adapted to each contact pin of a squib short-circuit the pins and a first grounding contact adapted to contact an ground contact of a squib connector. It comprises further at least one second grounding contact adapted to contact an electroconductive part of a squib and a support structure connecting the two contact members and a second grounding contact with each other, which support structure is essentially parallel to the plug in direction of the retainer insert. As with all embodiments described herein, the support structure of this shorting clip most preferably also connects the first grounding contacts or contact with the contact members and the second grounding contact. This way, all functional elements of the shorting clip are supported by a structure running essentially parallel to the insertion direction and thus it is no longer necessary to provide a supporting base structure underneath the base of the retainer insert, as it was necessary with the prior art.

In all the embodiments described herein, the support structure(s) is(are) preferably a flat wall, the surface normal of the wall being essentially perpendicular to the plug-in direction. Still further, in all the embodiments described herein, also the contact members and grounding contacts are preferably flat wall sections. Yet still further, in all the embodiments described herein, all the elements of the shorting clip are preferably flat wall sections, in particular all other elements of the shorting clip connecting the support structure, contact members and grounding contacts with each other.

The present invention allows using standardized retainer inserts in an ignition system, since the shorting clip is designed to fit into the "interior" of standardized retainer inserts without the necessity to provide a support structure connecting the functional parts of the shorting clip—i.e. grounding contacts and shorting contacts—under the base of the retainer insert, i.e. between the bottom of the receptacle or socket of a squib and the housing of the retainer insert. This is preferably achieved by providing all elements of the shorting clip (which connect the functional elements) in form of flat, preferably curved walls, the surface normal of which are essentially perpendicular to the plug-in direction In this way, the shorting clip does not enlarge the construction or installation height of the assembly of retainer insert in the receptacle of an ignition system. All of this is achieved by a shorting clip, which does not only provide a shorting function and an grounding contact to the squib connector but also an grounding contact to the housing of the squib.

The inventive construction of the shorting clip allows to dispense the relatively rigid support structures of the prior art, so that the shorting clip herein does not need any base structure with cut-outs for the reception of shorting pins or any ring-shaped support structure as the prior art.

4. DESCRIPTION OF THE PREFERRED EMBODIMENTS

The following invention is described exemplarily with reference to the enclosed figures, in which FIGS. 1A to C show schematic illustrations of an airbag retainer insert including a shorting clip in accordance with the invention;

Figure 1:
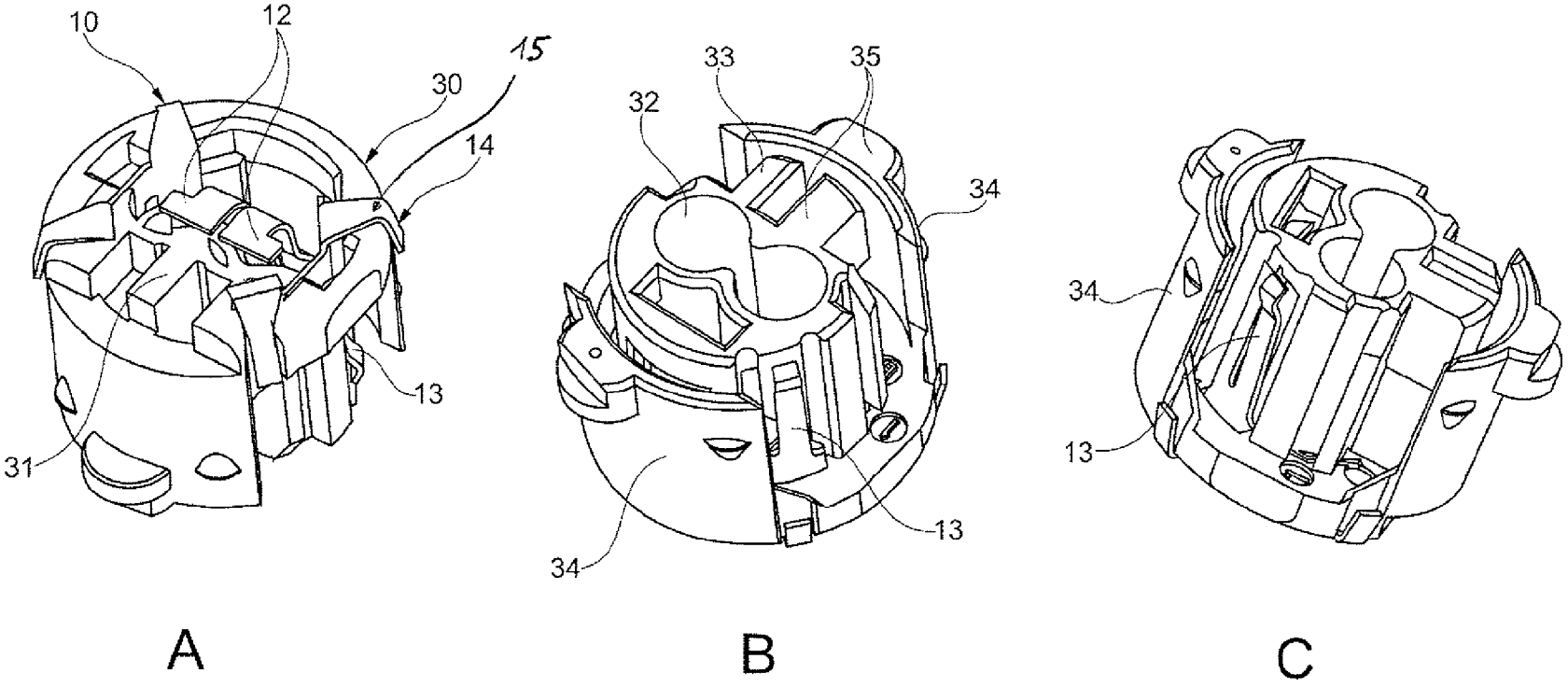

FIG. 1A-C show different views of an assembly of a retainer insert 30 onto which a shorting clip 10 is mounted. In view of FIG. 1A, the retainer insert 30 is shown upside down. In FIG. 1B the retainer insert is shown with its front face directed to the observer and FIG. 1C shows the retainer insert of FIG. 1B rotated by 90°. As one can see from the figures, the retainer insert 30 has a substantially cylindrical shape with a base 31 (cf. FIG. 1A). The retainer insert 30 has openings 32 adapted to receive the pins of a squib (cf. FIG. 1B). The front face 33 is adapted to receive a plug part of a squib connector and cylindrical wall segments 34 are arranged between the base 31 and the front face 33. The retainer insert is provided with several coding ribs and projections 35, which ensure that only a correspondingly shaped squib connector can be assembled with the retainer insert and/or that the retainer insert is positioned in only one orientation with regard to the squib connector and/or the squib receptacle of the igniter. The retainer insert shown in the figures can be a standardized part. Mounted in the retainer insert 30, a shorting clip 10 is shown comprising two contact members 12 adapted to each contact a pin of an squib to short circuit the pins. Thus when the retainer insert is assembled in a squib receptacle, the contact pins are arranged inside of the openings 32 and are in contact with the contact members 12 and only bend out of contact upon proper connection with a squib connector. The shorting clip further comprises a first grounding contact 13, which is adapted to contact a corresponding ground contact of the squib connector in assembled condition. Further, the shorting clip comprises four second grounding contacts 14 adapted to contact an electro-conductive part of the retainer receptacle when the retainer insert is mounted in it. The contact members 12, the second grounding contacts 14 and the first grounding contact 13 are supported by a common support structure which runs essentially parallel to the plug-in direction of the retainer insert 30. The support structure will be explained in more detail under reference to FIG. 5.

Figure 2:
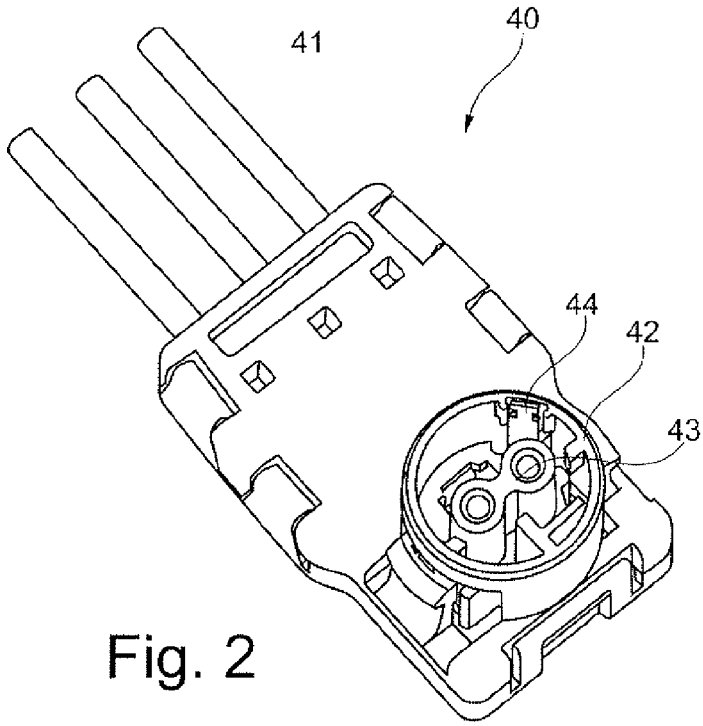
FIG. 2 shows a schematic view of a squib connector.
Figure 3:
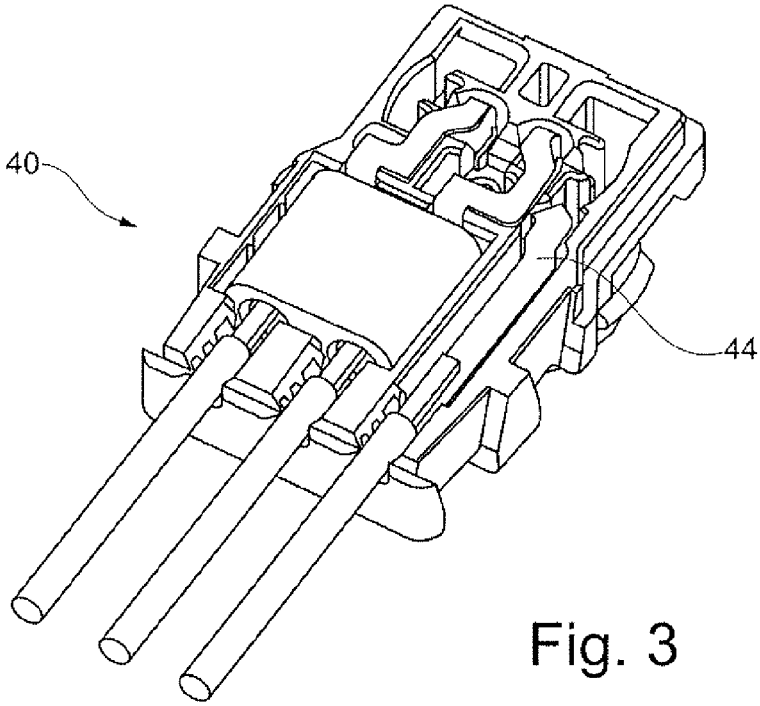
FIG. 3 shows another schematic view of the squib connector according to FIG. 2.

In FIGS. 2 and 3, exemplarily a squib connector 40 is shown which is adapted to mate the retainer insert of FIGS. 1A to C. The squib connector 40 comprises cables 41, which connect the connector with suitable control electronics of a SRS system. The connector further comprises a plug-in projection 42 which is adapted to be arranged inside of the wall segments 34 of the retainer of FIGS. 1A to C. Inside of the plug-in projection 42, two cylindrical contact projections 43 are arranged which fit into the opening 32 provided in the retainer insert (cf. FIG. 1B). Inside of the contact projections 43, contacts 45 are arranged which establish, in assembled condition, a contact with the contact pins of the squib. Inside of the plug-in projection 42, further a connector grounding contact 44 is arranged which in assembled condition will be in contact with the first grounding contact 13 of the shorting clip of the present invention, as will be explained in more detail under reference to FIG. 4 below.

Figure 4:
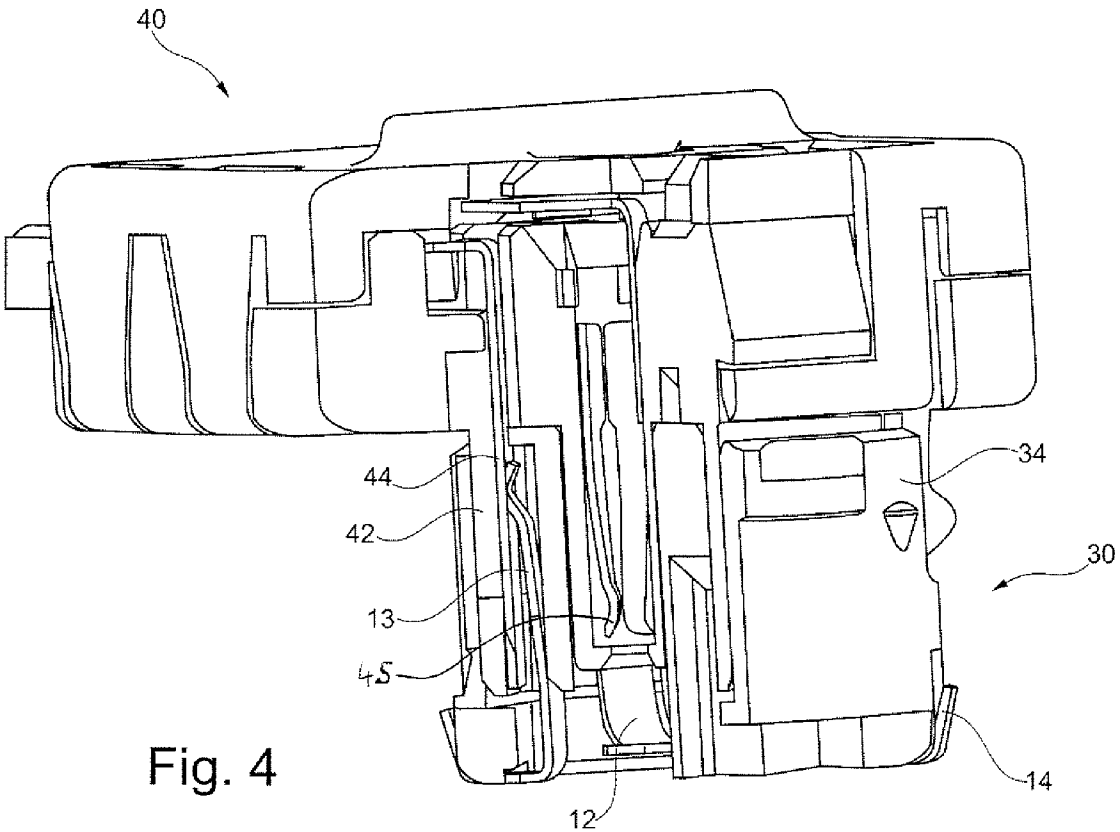
FIG. 4 shows a schematic and partially cut view of the squib connector of FIGS. 2 and 3 when connected to the retainer insert according to FIG. 1.

In FIG. 4, the squib connector 40 is shown in assembled condition with the retainer insert 30. As one can see from FIG. 4, the plug-in projection 42 is arranged inside of the retainer insert and surrounded by the cylindrical wall segments 34. From FIG. 4, the electric contacts 45 of the squib connector are recognizable. One can also derive from FIG. 4 how the first grounding contact 13 of the shorting clip is in contact with the grounding contact 44 of the squib connector 40. The second grounding contacts 14 are arranged outside of the retainer insert.

In the following, the shorting clip of the present invention will be explained with reference to FIGS. 5A to 5C, which show the same shorting clip 10 in a schematic illustration under different perspectives. The contact members 12 are shaped as contact tongues having free ends adapted to each contact a pin of a squib to short-circuit the pins. With their respective opposite ends, the tongues 12 are mounted to a common section 16. The skilled person will recognize that the contact members, respectively tongues, are arranged essentially parallel to the plug-in direction. The common section 16 is provided in form of a ring section, which is bent in a plane essentially perpendicular to the plug-in direction. The shorting clip further comprises two support structures 17, which are arranged essentially opposite to each other with regard to the common section 16 to which they are connected. One can derive from FIG. 5 that the two support structures 17 are arranged each at one end of the ring-shaped common section 16 and extend essentially parallel to the contact members 12. One can further derive from FIG. 5 that the support structures 17 extend beyond the free ends of the contact members 12. Each support structure 17 comprises at its free end a further ring section 18, which is also arranged essentially in a plane perpendicular to the plug-in direction. The further ring sections 18 are provided with the first 13 and the second 14 grounding contacts.

Each second grounding contact 14 is provided in form of a contact wing comprising a connecting portion 15 which is arranged in a plane essentially normal to the plug-in direction of the retainer insert. A contact portion 19 is arranged at an angle to the connecting portion 15 and adapted to contact an electro-conductive part of the squib. One can best derive from FIG. 1A that the connecting portion 15 is the only part of the shorting clip which is arranged under the base 31 of the retainer insert 30. Due to the structure of the shorting clip in the embodiment shown, the connecting portion 15 and the contact portion 19 are the only parts of the shorting clip, which are located outside of the retainer insert when mounted thereto. Thereby, a particular compact design can be realized. One can further derive from FIG. 5 that the common section 16 and the support structure 17 with its further ring sections 18 are provided in form of curved wall sections. The common section 16, the support structures 17 and the ring sections 18 extend essentially in a cylinder portion having its longitudinal axis parallel to the plug-in direction. This cylinder portion, or curved wall, remains open around the cylinder longitudinal axis, i.e. the shorting clip structure remains flexible in radial directions. Further, the shorting clip structure is formed with portions which extend alternatively in a plane perpendicular to the plug-in direction and parallel to the plug-in direction. This structure results in a kind of U-shape with the support structure 17 forming the branches of the U and in which the common section 16, corresponding to the bottom section of the U is bent around the longitudinal axis of the cylinder. Such a configuration also contributes to the flexibility of the shorting clip, in particular in extension around this axis. The inventive construction offers the advantages of a highly flexible design, which reduces the requirement of tight production tolerances and is thus more economic to produce and to assemble.

The whole connecting structure, including the common section 16, the support structures 17 and the ring sections 18 electrically connects the contact members 12, 13 and 14 with each other, is completely arranged between the base 31 and the front face 33 of the retainer insert 30 and is in full essentially parallel to the plug in axis. The only elements of the shorting clip, but this connecting structure, which are not essentially parallel to the plug in axis are the contact members 12, 13 and 14. The only elements located inside the curved wall are the contact members 12. There is no any risk of unexpected short circuit with other parts of the short circuit except with the contact members 12, contrarily to prior art shorting clips having a wall extending in the bottom of the retainer in a plane perpendicular to the plug-in direction and in which holes are cut out so as to leave that the squib pins pass through.

Figure 5:
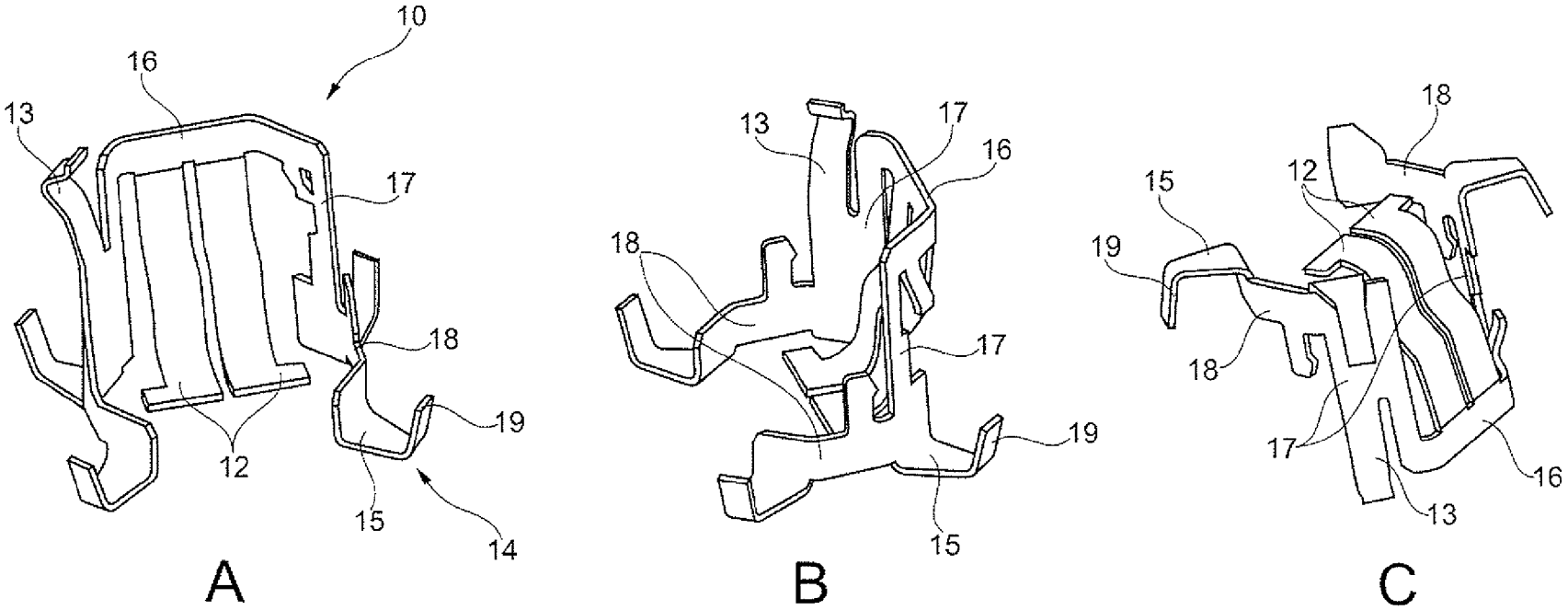
FIGS. 5A-C show different schematic views of a shorting clip in accordance with the invention.

As one can see from FIG. 5 the support structure 17, common section 16 and further ring section 18 are curved walls, the surface normal of the walls being essentially perpendicular to the plug-in direction. The term "essentially perpendicular" used herein means that if perfect perpendicularity would be 90°, than "essentially perpendicular" denotes an angle of more than 75°, preferably more than 85° and most preferably more than 88°. In theory, a perfect 90° is of course most preferred but may in practice be difficult to achieve. Similarly, the term "arranged essentially parallel to the plug-in direction" used herein means that not necessarily a perfect parallelism in the mathematical sense is given, but "essentially parallel" allows for an angle of deviation from a perfect parallelism. This angle of deviation is preferably less than 15°, more preferably less than 10° and most preferably less than 5°. In theory, a perfect parallelism is of course most preferred but in practice may be difficult to achieve.

Although the shorting clip 10 shown is made from one integral piece of sheet metal which is cut and bent to the desired shape, it is of course also possible to manufacture the clip from several parts which are suitably connected with each other. Obviously, the connection may not prevent the function of the shorting clip, i.e. to electrically connect the different contact elements of the clip with each other. Naturally, for the same reason the clip 10 is made from some electroconductive material.

The invention claimed is:

1. A shorting clip for an ignition system adapted to be mounted in a retainer insert, comprising:

two contact members adapted to each contact a pin of a squib to short-circuit the pins;

at least one first grounding contact adapted to contact a ground contact of a squib connector;

at least one second grounding contact adapted to contact an electroconductive part of a squib; and a support structure connecting the two contact members and the first and second grounding contact with each other, which support structure is adapted to be arranged in full essentially parallel to a plug-in direction of the retainer insert, wherein the at least one second grounding contact is provided in form of a contact wing comprising a connecting portion, which is arranged in a plane essentially normal to the plug-in direction of the retainer insert and a contact portion arranged at an angle to the connecting portion adapted to contact the electroconductive part of the squib receptacle, whereby the connecting portion is the only part of the shorting clip which is arranged under a base of the retainer insert when mounted thereon.

2. The shorting clip according to claim 1, further comprising a common section and ring sections, forming with the support structure a connecting structure, for electrically connecting the two contact members, extending in full essentially parallel to the plug-in direction of the retainer insert.

3. The shorting clip according to claim 1, wherein the shorting clip is shaped such that the connecting portion and the contact portion are the only parts of the shorting clip which are located outside of the retainer insert when mounted thereon.

4. The shorting clip according to claim 1, wherein the two contact members are shaped as contact tongues having each a free end adapted to contact the pin of the squib to short-circuit the pins, which tongues are mounted with their respective opposite ends to a common section which section is in turn connected with the support structure.

5. The shorting clip according to claim 1, comprising two support structures arranged essentially opposite to each other with regard to a common section and wherein the two contact members are arranged between the support structures.

6. The shorting clip according to claim 3, which does not comprise any base structure with cut-outs for the reception of shorting pins and no ring-shaped support structure.

7. A shorting system for an ignition system comprising:

a retainer insert having a substantially cylindrical shape with a base provided with at least one opening adapted to receive the pins of a squib; a front face adapted to receive a plug-part of a squib connector and cylindrical wall sections arranged between a base and a front face; and a shorting clip according to claim 1 adapted to be mounted with the retainer insert.

8. The shorting system according to claim 7, wherein the at least one second grounding contact is provided in form of the contact wing comprising the connecting portion, which is arranged in the plane essentially normal to the plug-in direction of the retainer insert and the contact portion arranged at an angle to the connecting portion adapted to contact the electroconductive part of the squib receptacle, whereby the connecting portion is the only part of the shorting clip which is arranged under the base of the retainer insert.

9. The shorting system according to claim 7, wherein the shorting clip is shaped such that the connecting portion and the contact portion are the only parts of the shorting clip which are located outside of the substantially cylindrical retainer insert when mounted therein.

10. The shorting system according to claim 7, wherein the shorting clip comprises two support structures arranged essentially opposite to each other and wherein the two contact members are arranged between the support structures and a common section is connected to both support structures and wherein the support structures and the two contact members are adapted to be arranged, preferably completely, between the base and the front face of the retainer insert.

11. A shorting clip for an ignition system adapted to be mounted in a retainer insert, comprising:

two contact members adapted to each contact a pin of a squib to short-circuit the pins;

at least one first grounding contact adapted to contact a ground contact of a squib connector;

at least one second grounding contact adapted to contact an electroconductive part of a squib; and a support structure connecting the two contact members and the first and second grounding contact with each other, which support structure is adapted to be arranged in full essentially parallel to a plug-in direction of the retainer insert, said support structure comprising two support structures arranged essentially opposite to each other with regard to a common section, wherein the two contact members are arranged between the support structures, and wherein the common section is shaped in form of a ring section bent in a plane essentially perpendicular to the plug-in direction and wherein the support structures are arranged each at one end of the ring section, comprise a further ring section at their free ends which are curved in a plane essentially perpendicular to the plug-in direction, and from which the first and the second grounding contacts extend.

12. The shorting clip according to claim 11, wherein the support structure, the common section and the further ring section are curved walls, the surface normal of the walls being essentially perpendicular to the plug-in direction.

13. The shorting clip according to claim 11, further comprising a common section and ring sections, forming with the support structure a connecting structure, for electrically connecting the two contact members, extending in full essentially parallel to the plug-in direction of the retainer insert.

14. The shorting clip according to claim 11, wherein the two contact members are shaped as contact tongues having each a free end adapted to contact the pin of the squib to short-circuit the pins, which tongues are mounted with their respective opposite ends to a common section which section is in turn connected with the support structure.

15. The shorting clip according to claim 11, which does not comprise any base structure with cut-outs for the reception of shorting pins and no ring-shaped support structure.

* * * * *